US009028920B2

(12) United States Patent
Schimpff et al.

(10) Patent No.: US 9,028,920 B2
(45) Date of Patent: May 12, 2015

(54) PRETREATMENT OF METAL SURFACES PRIOR TO PAINT USING POLYANILINE PARTICLES

(75) Inventors: David Schimpff, Dry Ridge, KY (US); Bruce Dunham, West Chester, OH (US); William Frisz, Cincinnati, OH (US); Jun O. Zhang, Mason, OH (US)

(73) Assignee: DuBois Chemicals, Inc., Sharonville, OH (US)

( * ) Notice: Subject to any disclaimer, the term of this patent is extended or adjusted under 35 U.S.C. 154(b) by 301 days.

(21) Appl. No.: 13/432,031

(22) Filed: Mar. 28, 2012

(65) Prior Publication Data

US 2013/0260158 A1 Oct. 3, 2013

(51) Int. Cl.

| | |
|---|---|
| ***B05D 3/10*** | (2006.01) |
| ***B05D 7/14*** | (2006.01) |
| *B05D 7/00* | (2006.01) |
| *B05D 1/38* | (2006.01) |

(52) U.S. Cl.

CPC *B05D 7/14* (2013.01); *B05D 3/102* (2013.01); *B05D 7/54* (2013.01); *B05D 1/38* (2013.01); *B05D 2202/10* (2013.01); *B05D 2202/25* (2013.01)

(58) Field of Classification Search

CPC ..... C23C 22/05; C23C 22/06; C23C 22/34; C23C 22/48; B05D 2202/00; B05D 2205/10; B05D 1/38; B05D 1/02; B05D 3/02; B05D 3/102; B05D 7/14; B05D 7/54; B05D 1/08

USPC ..... 427/327–330

See application file for complete search history.

(56) References Cited

U.S. PATENT DOCUMENTS

| | | | | |
|---|---|---|---|---|
| 5,137,991 | A * | 8/1992 | Epstein et al. | 525/540 |
| 5,532,025 | A | 7/1996 | Kinlen et al. | |
| 5,721,056 | A | 2/1998 | Wessling | |
| 6,015,613 | A | 1/2000 | Kinlen et al. | |
| 6,060,116 | A * | 5/2000 | Kulkarni et al. | 427/213.3 |
| 6,153,080 | A * | 11/2000 | Heimann et al. | 205/199 |
| 6,652,977 | B2 | 11/2003 | Zhang | |
| 6,736,908 | B2 | 5/2004 | Sako et al. | |
| 6,887,308 | B2 | 5/2005 | Zhang | |
| 7,615,257 | B2 * | 11/2009 | Jung et al. | 427/508 |
| 7,833,332 | B2 | 11/2010 | Moore | |
| 2003/0065090 | A1 * | 4/2003 | Kelly et al. | 525/63 |
| 2006/0134339 | A1 | 6/2006 | Wang et al. | |
| 2008/0026157 | A1 | 1/2008 | Jung et al. | |
| 2009/0114118 | A1 * | 5/2009 | Moore | 106/14.44 |

FOREIGN PATENT DOCUMENTS

| | | | |
|---|---|---|---|
| CN | 100402583 | C | 7/2008 |
| CN | 101693811 | A | 4/2010 |
| EP | 1258513 | A2 | 11/2002 |
| WO | 03/027203 | A2 | 4/2003 |
| WO | 2008/094193 | A2 | 8/2008 |
| WO | 2009084849 | A2 | 7/2009 |

OTHER PUBLICATIONS

International Search Report and Written Opinion relating to PCT Application No. US2013/034009, dated Aug. 9, 2013.

Alam et al., "Development of nanostructured polyanline dispersed smart anticorrosive composite coatings", Polymers for Advanced Technologies, vol. 19, Issue 7, pp. 882-888, Jul. 2008.

Khan et al., "Recent Developments in Intrinsically Conductive Polymer Coatings for Corrosion Protection", Chemical Engineering Research Bulletin 14, pp. 73-86, Nov. 22, 2010.

Li et al., "The preparation of polyaniline waterborne latex nanoparticles and their films with anti-corrosivity and semi-conductivity", Colloids and Surfaces A: Physicochem. Eng. Aspects 248, pp. 111-120, Aug. 28, 2004.

ASTM International Designation: D 1654-05, "Standard Test Method for Evaluation of Painted or Coated Specimens Subjected to Corrosive Environments", Apr. 11, 2005.

* cited by examiner

*Primary Examiner* — David Turocy

(74) *Attorney, Agent, or Firm* — Dinsmore & Shohl LLP

(57) ABSTRACT

Embodiments of a method of pretreating a metal substrate prior to painting comprise applying a first coating solution onto the metal substrate wherein the first coating solution comprises polyaniline particles at a pH less than 7 to yield a first coating on the metal substrate, rinsing the metal substrate to remove unreacted polyaniline particles, and applying a second coating solution post-rinse which comprises at least one acid and a silane composition at a pH less than 7 to yield a second coating on the metal substrate.

11 Claims, No Drawings

PRETREATMENT OF METAL SURFACES PRIOR TO PAINT USING POLYANILINE PARTICLES

TECHNICAL FIELD

The present invention is generally directed to the pretreatment of metal surfaces, and is specifically directed to pretreating metal surfaces to yield corrosion resistance and increased paint adhesion on the metal surface prior to painting.

BACKGROUND

One of the last steps of manufacturing a good prior to packaging is coating; most commonly referred to as painting. In addition to the aesthetic value, coating protects the good from the elements that cause corrosion. As would be known in the industry, manufactured goods require surface preparation before they are subjected to a final coating stage, such as a painting stage. Surface preparation typically involves degreasing or cleaning and subsequent coating pretreatment steps. Finished goods (e.g., auto parts, appliance parts, furniture parts, heavy equipment) are commonly fabricated from sheet, roll, forged, cast, and/or extruded materials (e.g., steel, aluminum, zinc, zinc coated, copper, plastic). During fabrication, process fluids (e.g., buffing compounds, coolants, greases, lubricating oils, rust inhibitors, pressworking fluids, and quench oils) are necessary to enable efficient and quality production. Cleaning is required to remove these process fluids, material fines/shavings, and other surface debris or contaminants that are generated as a result of the manufacturing process. Subsequent pretreatment steps are required to ensure coating adhesion and corrosion resistance. Corrosion remains a significant concern when processing metal parts. In addition to degrading the aesthetic look and feel of the metal parts, it also can degrade the mechanical properties and the strength of the metal parts. Consequently, pretreatment of metal substrates has been utilized to produce anti-corrosive properties and longevity of the metal substrate.

Conventional methods have utilized various pretreatment methodologies to address corrosion. Pretreatment with metal phosphate primers (e.g., zinc or iron phosphate) have been used; however, metal phosphates are environmentally undesirable. Furthermore, after pretreatment with metal phosphate primer, the next steps may include a rinse using chromic acid prior to painting the metal surface. Chromium based systems, while providing strong anti-corrosive properties, also are not environmentally desirable and present worker safety issues.

Accordingly, there is a need for pretreatment coatings which are environmentally friendly, while providing anti-corrosion benefits and enhanced paint adhesion.

SUMMARY

According to one embodiment, a method of pretreating a metal substrate prior to painting comprises applying a first coating solution onto the metal substrate wherein the first coating solution comprises polyaniline particles at a pH less than 7 to yield a first coating on the metal substrate, rinsing the metal substrate to remove unreacted polyaniline particles, and applying a second coating solution post-rinse which comprises at least one acid and a silane composition at a pH less than 7 to yield a second coating on the metal substrate.

These and additional objects and advantages provided by the embodiments of the present invention will be more fully understood in view of the following detailed description.

DETAILED DESCRIPTION

Embodiments of a method of pretreating a metal substrate prior to painting comprise providing at least one metal substrate, applying a first coating solution comprising polyaniline particles at a pH less than 7 to yield a first coating on the metal substrate, rinsing the metal substrate to remove unreacted polyaniline particles, and applying a second coating solution post-rinse which comprises at least one acid and a silane composition at a pH less than 7 to yield a second coating on the metal substrate.

Various metals are contemplated for use in the metal substrates of the present invention. In one embodiment, the metal substrate may comprise steel, aluminum, or combinations thereof. The metal substrate must be cleaned prior to the application of the first coating solution. Various cleaning methodologies are contemplated as suitable. For example, the metal substrate may be cleaned with an alkaline detergent, including those made available e.g., under the names Liquid MC 726 and Liquid Ferro Terj by Dubois Chemical.

The first coating solution is generally applied utilizing a liquid carrier. The first coating solution may be applied by using an open spray system, a cabinet spray washer, a belt washer, a tumbling washer, a wand system, a garden sprayer, a pressure washer, a vibratory deburring washer, or by simply immersing the metal part in a tank containing the coating composition, or by steaming a metal part with the solution. The residence or application time of the first coating solution on the metal substrate prior to rinsing may vary, for example, ranging from about 15 seconds to about 5 minutes.

The first coating solution may comprise organic acids, inorganic acids, or mixtures thereof. Most importantly, to achieve maximum corrosion resistance and paint adhesion, the first coating includes a dispersion of intrinsically conductive polymers (ICP). As used herein, ICPs are polymers with $\pi$ bonded electrons, which allow a free movement of electrons. The ICPs can achieve conductivities in the range of about $10^{-7}$ to about 500 siemens per centimeter (S/cm), or in a further embodiment, a preferred range is $10^{-1}$ to $10^{2}$ S/cm.

Suitable ICPs may include polyaniline in a substituted or unsubstituted form or any other ICPs with similar redox properties such as polypyrrole, polythiophene, polyethylenedioxythiophene (PEDOT) and derivatives thereof. While various ICPs are suitable, the discussion below will focus on polyaniline for convenience. The polyaniline dispersion can include an acid doped polyaniline composition or an undoped polyaniline. The acid doping may occur during oxidation of aniline to polyaniline. As would be familiar to the person of ordinary skill, the oxidation may utilize a suitable oxidizing agent, e.g., persulfate. Various dopants are contemplated as suitable. For example, and not by way of limitation, these suitable dopants may include the following: inorganic acids like hydrochloric acid, sulfuric acid, or phosphoric acids; organic acids including aliphatic acids (e.g., acetic acid), or aromatic sulfonic acids (e.g., polystyrene sulfonic acids, naphthalene sulfonic acids, dodecylbenzenesulfonic acids, or dinonylnaphthalene sulfonic acid).

After oxidation, the polyaniline polymers are generally in a powder form, which is purified and then dispersed in a solvent material to create the polyaniline dispersion. The solvents may include polar solvents, nonpolar solvents, or a mixture of solvents. After dispersion, the dispersion of polyaniline may optionally be incorporated into the acid solution described above. As stated above, the acid solution may comprise one or more acids selected from organic acids, inorganic acids, and mixtures thereof. In one embodiment, the acid solution may be a mixture of organic acids, polycarboxylic acids, and inorganic acids. For example and not by way of limitation, the inorganic acids may comprise sulfuric acid, phosphoric acid, hydrochloric acid, nitric acid, or mixtures thereof. The organic acids, which optionally are aliphatic, polycarboxylic or aromatic, may include para-toluene sulfonic acid, acetic acid, lactic acid, propionic acid, butyric acid, citric acid, glycolic acid, oxalic acid, tartaric acid, or mixtures thereof. The amount of acid may vary from about 0.0001 to about 15.0% by wt., or from about 0.0005 to about 10.0% by wt., or from about 0.0008 to about 5.0% by wt. acid. In an exemplary embodiment, the acid mixture may comprise inorganic acid, organic acid, and polycarboxylic acid, each being present at an amount of 0.1 to 5%. Without being bound by theory, by using a mixture of acids, instead of a single acid, the first coating solution may, in specific embodiments, provide improved adhesion, improved support of redox mechanism by redoping, and/or improved complexing of polyvalent ions.

Various ranges are contemplated for the pH of the coating solution. In one embodiment, the pH range is from about 1 to about 6, or about 1 to about 4. While the pH for the first coating solution is typically in the acidic range, it is expected that the first coating solution would also be suitable in alkaline pH ranges. Moreover, the first coating step may be conducted at room temperature or at elevated temperatures. For example, the first coating step may occur at a temperature of from about 60° F. to about 180° F.

Additionally as stated above, the first coating solution may comprise water, or other optional organic solvents and additives. For example, the organic solvents that may be used in this invention include, for example, glycols like $C_2$ to $C_8$ alkylene glycols as well as ethers thereof. Other organic solvents that may be used include alkanols (including diols), xylene, toluene, pyrrolidone, and N-methylpyrrolidone. For example and not by way of limitation, the organic solvent may comprise methanol, hexylene glycol, 1,2-propanediol, 3-methoxy-3-methyl-1-butanol, dipropylene glycol, ethylene glycol, glycerine, phenoxyethanol, polyethylene glycol and mixtures thereof. In exemplary embodiments, the organic solvent may comprise methanol, hexylene glycol, and mixtures thereof. In specific embodiments, it is contemplated that the solvent is diluted with about 50.0 to 99.99%, or from about 60.0 to about 99.95%, or from about 75.0 to about 99.90% by weight water.

Various compositional amounts are contemplated for the ICP (e.g., polyaniline) particles in the first coating solution. For example, the first coating solution may comprise about 0.001 to about 20% by weight polyaniline particles, or about 0.1 to about 5% by weight of polyaniline particles. Moreover, the polyaniline particles comprise various particle sizes. For example, the polyaniline particles may comprise a particle size of between about 0.001 μm to about 100 μm. In one embodiment, the polyaniline particles may include nanoparticles having a size between about 0.001 μm (1 nm) to about 0.1 μm (100 nm).

The first coating solution or the sub-components are commercially available. For example, the first coating solution with dispersed polyaniline particles may be commercially available under the Ormecon® line of products produced by Enthone®.

Without being bound by theory, the polyaniline based first coating solution in combination with a sealer (i.e., second coating solution) is beneficial because the combination synergistically provides suitable paint adhesion, while also providing excellent film formability, and anti-corrosivity.

After the application of the first coating step, the present process utilizes a rinsing step to remove any unreacted material, for example, any unreacted polyaniline particles or excess acid. Without being bound by theory, this rinsing step helps minimize undesirable side reactions. It is desirable to first bond the polyaniline to the metal surface, then rinse off unreacted material, and then apply a second coating with a coupling agent (e.g., silane) and acid (e.g., fluorozirconic acid) of the second coating solution. This ensures that the final coating, which is produced by the reaction of the bonded polyaniline with the fluorozirconic acid and silane coupling agent, is properly adhered to the metal surface. Without a rinse step, side reactions between unbonded polyaniline and the silane coupling agent and the fluorozirconic acid would produce impurities. Consequently, the present inventors recognized that applying the polyaniline, rinsing, and then applying the second coating solution with acid and silane coupling agent yields a superior primer coating due in part to the reduction of impurities and side reactions. In contrast to the present process of applying separate first and second coating solutions, a single coating solution including the polyaniline, fluorozirconic acid, and silane in the same composition would not yield as effective a coating due to these unwanted side reactions.

The rinsing step may utilize any suitable solvent, for example, water or any of the organic solvents listed above. It is also contemplated that rinsing may include cleaning materials, such as a suitable alkaline detergent described above. The rinsing step may be conducted at room temperature or at elevated temperatures. For example, the rinsing may occur at a temperature up to about 150° F.

While it may be desirable from a cost and efficiency standpoint to minimize the number of coating or rinsing steps, it is contemplated that the first coating step or rinsing step may occur over one or multiple steps or stages.

After rinsing, the second coating may be applied, which includes a silane composition which is used as a coupling agent, and an additional acid, which is utilized to increase the corrosion resistance and paint adhesion. The coupling agent reacts: a) with the active sites on the metal surface present between the void spaces between the polyaniline particles; and b) with the polyaniline particles.

The silane compositions are organofunctional silanes including silicon having bonded thereto one or more alkoxy groups and preferably one additional organofunctional compound such as an amino, ureido, epoxy, vinyl, cyanato, or mercapto group. One type of organofunctional silane that may be utilized is an aminoalkoxysilane. Another type of organofunctional silane that may be utilized is an alkoxy silane. Organofunctional silanes which treat metal surfaces are disclosed, for example, in U.S. Pat. Nos. 6,409,874, 5,750,197; 6,534,187; and 6,270,884, the disclosures of which are hereby incorporated by reference in their entirety.

Suitable aminosilanes include gamma aminopropyltriethoxysilane, aminopropyltrimethoxysilane, aminoethylaminopropyltrimethoxysilane, aminoethylaminopropyltriethoxysilane, as well as bis-aminosilanes. A suitable mercaptosilane is gamma mercaptopropyltrimethoxysilane. Other silanes include gamma ureidopropyltrialkoxysilane, vinyltrimethoxysilane, vinyltriethoxysilane, vinyltriacetoxysilane, methacryloxypropyltrimethoxysilane, gammaglycidoxypropyltrimethoxysilane, as well as others. Below is list of some structural examples of aminosilanes:

$H_2NCH_2CH_2CH_2CH_2CH_2CH_2NHCH_2CH_2CH_2Si(OCH_3)_3$ $H_2NCH_2CH_2CH_2CH_2SiCH_3(OCH_2CH_3)_2$ $H_2NCH_2CH_2CH_2Si(OCH_2CH_3)_3$ $H_2NCH_2CH_2CH_2Si(OCH_3)_3$ $H_2NCH_2CH_2CH_2SiO_{1.5})_n$ wherein n=1 to 10

$H_2NCH_2CH_2CH_2SiCH_3(OCH_3)_2$ $H_2NCH_2CH_2NHCH_2CH_2CH_2Si(OCH_2CH_3)_3$ $H_2NCH_2CH_2NHCH_2CH_2CH_2Si(OCH_3)_3$ $H_2NCH_2CH_2NHCH_2CH_2CH_2SiCH_3(OCH_3)_2$ $H_2NCH_2CH_2NHCH_2CH_2NH\ CH_2CH_2CH_2Si(OCH_2CH_3)_3$ $H_2NCH_2CH_2NHCH_2CH_2NH\ CH_2CH_2CH_2Si(OCH_3)_3$ $H_2NCH_2CH_2NHCH_2CH_2NH\ CH_2CH_2CH_2SiCH_3(OCH_2CH_3)_2$ $H_2NCH_2CH_2NHCH_2CH_2NH\ CH_2CH_2CH_2SiCH_3(OCH_3)_2$

Suitable commercial embodiments include the Silquest® line of products produced by OSI Specialties. One such suitable silane is Silquest® 1100, which has the following structure:

$H_2NCH_2CH_2CH_2SiCH_3\ (OCH_3)_2$

Regarding the amount of silane in the coating solution, it is possible to employ from about 0.0001 to about 30.0% by wt., or from about 0.0005 to about 15% by wt., or from about 0.5 to about 3% by wt. of silane. In further embodiments, it is also contemplated to use a silane cross-linking agent. Examples of suitable cross-linking agents are listed in U.S. Pat. No. 6,652,977, which is incorporated by reference herein in its entirety.

As stated above, an additional acid is utilized to further bolster the corrosion resistance and paint adhesion provided by the polyaniline particles. In one or more embodiments, the acid of the second coating solution comprises inorganic acids, organic acids, or combinations thereof. The inorganic acid of the second coating solution may comprise a metal fluoroacid. The metal fluoroacid of the second coating solution may be selected from the group consisting of fluorozirconic acid, fluorotitanic acid, and combinations thereof. The application of the second coating solution occurs for a period of about 15 seconds to about 5 minutes.

Various ranges are contemplated for the pH of the second coating solution. In one embodiment, the pH range is from about 1 to about 6.5, or about 3 to about 6. While the pH for the second coating solution is typically in the acidic range, it is expected that the second coating solution would also be suitable in alkaline pH ranges. Moreover, the second coating step may be conducted at room temperature or at elevated temperatures. For example, the second coating step may occur at a temperature of from about 60° F. to about 180° F.

In a specific embodiment, fluorozirconic acid is utilized in the second coating. As recognized by the present inventors, the zirconization process, which is facilitated by the addition of flurozirconic acid, provides excellent paint adhesion and corrosion resistance, while eliminating the environmental issues associated with phosphate or chromium based treatment compositions. Without being by theory, the zirconium and polyaniline work synergistically to further increase the corrosion resistance and paint adhesion above what is achievable by the zirconium or polyaniline particles singularly. Suitable commercial embodiment s for the second coating solution are contemplated, for example, DuraLink® 450 produced by Dubois Chemical.

Similar to the first coating solution, the second coating solution may comprise water, or other optional organic solvents and additives. For example, the organic solvents that may be used in this invention include, for example, glycols like $C_2$ to $C_8$ alkylene glycols as well as ethers thereof. Other organic solvents that may be used include alkanols (including diols), xylene, toluene, pyrrolidone, and N-methylpyrrolidone. For example and not by way of limitation, the organic solvent may comprise methanol, hexylene glycol or mixtures thereof, 1,2-propanediol, 3-methoxy-3-methyl-1-butanol, dipropylene glycol, ethylene glycol, glycerine, phenoxyethanol, polyethylene glycol and mixtures thereof. In exemplary embodiments, the organic solvent may comprise methanol, hexylene glycol, and mixtures thereof.

After the application of the second coating, it is contemplated that there also may be an additional rinsing step to remove any excess unreacted acidic material.

It is further noted that terms like "preferably," "generally," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of pretreating a metal substrate prior to painting comprising:

applying a first coating solution onto the metal substrate wherein the first coating solution comprises sulfuric acid, citric acid, and polyaniline particles at a pH less than 7 to yield a first coating on the metal substrate;

rinsing the metal substrate to remove unreacted polyaniline and excess acid; and applying a second coating solution post-rinse which comprises fluorozirconic acid and aminosilane at a pH less than 7 to yield a second coating on the metal substrate.

2. The method of claim 1 further comprising cleaning the metal substrate prior to the application of the first coating solution.

3. The method of claim 1 wherein the metal substrate comprise steel, aluminum, or alloys of each.

4. The method of claim 1 wherein the acid of the second coating solution further comprises organic acids.

5. The method of claim 1 wherein the second coating solution further comprises fluorotitanic acid.

6. The method of claim 1 wherein the first coating solution and the second coating solution are applied via spraying the metal substrate, immersing the metal substrate, or combinations thereof.

7. The method of claim 1 wherein the application of the first coating solution occurs for a period of about 15 seconds to about 5 minutes.

8. The method of claim 1 wherein the application of the second coating solution occurs for a period of about 15 seconds to about 5 minutes.

9. The method of claim 1 wherein the first coating solution comprises 0.1 to about 5% by weight polyaniline particles.

10. The method of claim 1 wherein the polyaniline particles comprise a particle size of between about 0.001 μm to about 100 μm.

11. The method of claim 1 wherein the polyaniline particles comprise nanoparticles having a particle size at or below 0.1 μm.

* * * * *

UNITED STATES PATENT AND TRADEMARK OFFICE

CERTIFICATE OF CORRECTION

PATENT NO. : 9,028,920 B2
APPLICATION NO. : 13/432031
DATED : May 12, 2015
INVENTOR(S) : David Schimpff et al.

It is certified that error appears in the above-identified patent and that said Letters Patent is hereby corrected as shown below:

On The Title Page,

(75) Inventors: "David Schimpff, Dry Ridge, KY (US);
Bruce Dunham, West Chester, OH (US);
William Frisz, Cincinnati, OH (US);
Jun O. Zhang, Mason, OH (US);"

should read

(75) Inventors: --David Schimpff, Dry Ridge, KY (US);
Bruce Dunham, West Chester, OH (US);
William Frisz, Cincinnati, OH (US);
Jun Q. Zhang, Mason, OH (US);--

Signed and Sealed this
First Day of March, 2016

Michelle K. Lee

Michelle K. Lee
*Director of the United States Patent and Trademark Office*